US009714544B2

(12) United States Patent
Gunsaulis

(10) Patent No.: US 9,714,544 B2
(45) Date of Patent: Jul. 25, 2017

(54) REAMER WITH REPLACEABLE ROLLING CUTTERS

(71) Applicant: The Charles Machine Works, Inc., Perry, OK (US)

(72) Inventor: Floyd R. Gunsaulis, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 457 days.

(21) Appl. No.: 14/281,575

(22) Filed: May 19, 2014

(65) Prior Publication Data

US 2014/0338979 A1 Nov. 20, 2014

Related U.S. Application Data

(60) Provisional application No. 61/825,334, filed on May 20, 2013.

(51) Int. Cl.
*E21B 10/28* (2006.01)

(52) U.S. Cl.
CPC ..... *E21B 10/28* (2013.01)

(58) Field of Classification Search
CPC ..... E21B 10/10; E21B 10/633; E21B 10/28
See application file for complete search history.

(56) References Cited

U.S. PATENT DOCUMENTS 2,086,680 A * 7/1937 Scott ..... E21B 10/28 175/335
2,103,583 A * 12/1937 Howard ..... E21B 10/28 175/335
2,174,587 A 10/1939 Love
2,557,619 A 6/1951 Swart
2,695,771 A * 11/1954 Salvatori ..... E21B 10/30 15/104.13
3,174,564 A * 3/1965 Morlan ..... E21B 10/06 175/332
3,917,011 A 11/1975 Hester
4,036,314 A 7/1977 Dixon et al.
4,141,421 A 2/1979 Gardner
4,228,863 A 10/1980 Liljekvist et al.
4,441,566 A 4/1984 Pessier et al.
(Continued)

FOREIGN PATENT DOCUMENTS

CA 2342262 A 9/2002
CN 202017451 A 10/2011
(Continued)

*Primary Examiner* — Shane Bomar
(74) *Attorney, Agent, or Firm* — Tomlinson McKinstry, P.C.

(57) ABSTRACT

A reamer for use in underground drilling back-reaming operations. The reamer comprises a body comprising a plurality of pockets. The pockets are configured such that an arm, a rolling cutter, and a retainer may fit within each of the pockets. Each of the rolling cutters is connected to each of the arms via a spindle. The rolling cutters are held on the spindle and connected to each of the pockets via a retainer. Each of the arms are secured to each of the pockets via a plurality of fasteners. A mechanical lock is used to secure at least one of the fasteners in place. Each of the arms comprise a grease passage and a pressure compensation system. The rolling cutters are replaceable with rolling cutters of like size or rolling cutters of different sizes and shapes.

28 Claims, 11 Drawing Sheets

(56) References Cited

U.S. PATENT DOCUMENTS

| | | | | |
|---|---|---|---|---|
| 4,533,003 | A | 8/1985 | Bailey et al. | |
| 4,548,284 | A * | 10/1985 | Shinn | E21B 10/30 175/325.4 |
| 4,614,242 | A | 9/1986 | Rives | |
| 4,915,181 | A | 4/1990 | Labrosse | |
| 5,035,293 | A | 7/1991 | Rives | |
| 5,337,843 | A | 8/1994 | Torgrimsen et al. | |
| 5,429,201 | A * | 7/1995 | Saxman | E21B 10/10 175/376 |
| 5,979,574 | A | 11/1999 | Osadchuk | |
| 5,992,542 | A | 11/1999 | Rives | |
| 6,527,066 | B1 * | 3/2003 | Rives | E21B 10/28 175/344 |
| 6,745,858 | B1 | 6/2004 | Estes | |
| 7,090,034 | B2 | 8/2006 | Rives | |
| 7,243,737 | B2 * | 7/2007 | Michael | E21B 10/26 175/385 |
| 7,845,437 | B2 | 12/2010 | Bielawa et al. | |
| 8,347,989 | B2 | 1/2013 | Buske et al. | |
| 2004/0060741 | A1 | 4/2004 | Shipalesky et al. | |
| 2009/0272582 | A1 * | 11/2009 | McCormick | E21B 10/14 175/336 |

FOREIGN PATENT DOCUMENTS

| | | | |
|---|---|---|---|
| WO | 01/92678 | A | 12/2001 |
| WO | 02/31313 | A | 4/2002 |
| WO | 2013/040408 | A | 3/2013 |

* cited by examiner

REAMER WITH REPLACEABLE ROLLING CUTTERS

CROSS REFERENCE TO RELATED APPLICATION

This application claims the benefit of provisional patent application Ser. No. 61/825,334 filed on May 20, 2013, the entire contents of which are incorporated herein by reference.

FIELD

The present invention relates generally to underground boring and, in particular, to a reamer assembly for enlarging an existing borehole.

SUMMARY

The present invention is directed to a reamer for use in underground drilling operations. The present invention is particularly applicable for use in underground formations containing rock and weathered rock material. The reamer comprises a body, a pocket formed on the body, an arm, a grease passage and a pressure compensation system disposed within the arm, a rolling cutter, a retainer, a fastener, and a spindle. The pocket comprises a retainer section, a cutter section, and an arm section. The arm is configured to fit within the arm section of the pocket, the rolling cutter is configured to fit within the cutter section of the pocket, and the retainer is configured to fit within the retainer section of the pocket. The fastener secures the arm to the arm section of the pocket. The spindle is connected at a first end to the arm and at a second end to the retainer. The rolling cutter fits over the spindle and is held between the arm and the retainer within the cutter section of the pocket. The rolling cutter rotates about the spindle without the use of roller bearings. The rolling cutter is also replaceable with a rolling cutter of a different size.

The present invention is also directed to a method for assembling a reamer used in underground drilling operations. The method comprises the steps of providing a body, forming a pocket on the body comprising a retainer section, a cutter section, and an arm section, securing a spindle to a first end of an arm, and securing the arm to the arm section of the pocket. The method further comprises the steps of placing a rolling cutter over the spindle such that the rolling cutter is held within the cutter section of the pocket, securing a retainer to a bottom end of the rolling cutter, and inserting the retainer into the retainer section of the pocket.

The present invention is further directed to a method for enlarging a borehole using a reamer, the method comprises drilling a borehole using a horizontal directional drill, and attaching the reamer to the drill string contained within the borehole. The reamer comprises a pocket formed on a body, wherein the pocket comprises a retainer section, a cutter section, and an arm section. The reamer also comprises an arm configured to fit within the arm section of the pocket, a rolling cutter configured to fit within the cutter section of the pocket, and a retainer configured to fit within the retainer section of the pocket. The reamer further comprises a fastener to secure the arm to the arm section of the pocket, and a spindle connected at a first end to the arm and at a second end to the retainer, wherein the rolling cutter fits over the spindle and is held between the arm and the retainer within the cutter section of the pocket, and wherein the rolling cutter rotates about the spindle without the use of roller bearings. The method further comprises the step of pulling the reamer back through the borehole while rotating the reamer such that the rolling cutter on the reamer contacts and enlarges the borehole.

DESCRIPTION

Horizontal directional drills or boring machines may be used to replace or install underground utilities with minimal surface disruption. The machines utilize a series of drilling pipes joined end to end, at an entry access point, to form a drill string. The drill string may be attached to a downhole tool which is thrust forward and selectively rotated through a soil formation forming a directional underground borehole. Once the downhole tool reaches a target point for the completion of the borehole, a reamer may be attached to the drill string or the downhole tool and pulled back through the borehole to enlarge the bore and install a new pipe or a utility service. This may be referred to as back-reaming.

Reamers may also be used in a similar fashion in the vertical drilling industry to enlarge boreholes. The reamers used in either horizontal or vertical underground drilling operations in hard rock formations may function using rotating rolling cutters with cutting elements or hardened steel teeth affixed to the rolling cutters that crush the rock as the reamers are forced through the rock formation. Reamers that operate in such formations are especially prone to wear.

Figure 1:
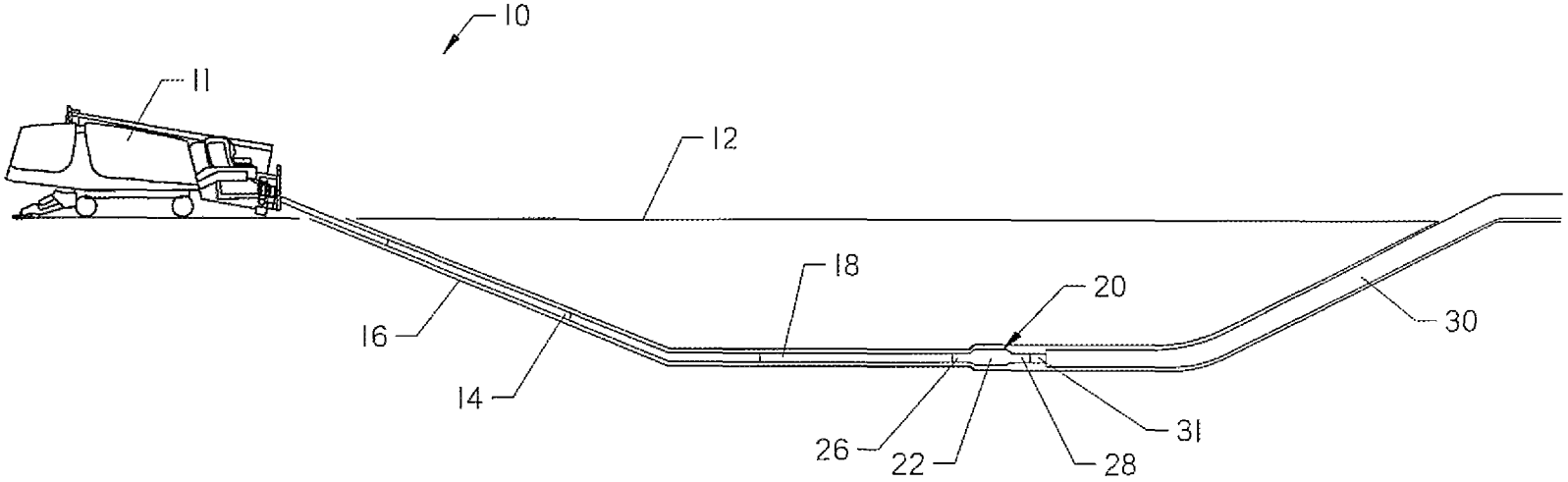
FIG. 1 is an illustration of a horizontal directional drilling back-reaming operation.

Turning now to the figures and first to FIG. 1, a horizontal directional drilling back-reaming operation 10 is shown. A boring machine 11 is shown on a ground surface 12. A drill string 14 is shown extending from the boring machine 11 and into a borehole 16. The borehole 16 is formed by a downhole tool (not shown) that drills underground. The drill string 14 comprises a plurality of drill pipe sections 18 connected end to end. A reamer 20 is shown connected to the drill string 14 within the borehole 16. The reamer 20 may also be connected to the downhole tool if the downhole tool is not removed from the borehole 16 before back-reaming operations begin.

Continuing with FIG. 1, the reamer 20 comprises a body 22. The body 22 comprises a first end 26, and a second end 28. The first end 26 of the reamer 20 may be connected to the drill pipe 18 or the downhole tool (not shown). The second end 28 of the reamer 20 may be connected to a utility service 30 via a swivel 31. The utility service 30 may include one or more pipes, one or more cables, or one or more conduits for use with buried utilities. The swivel 31 may also be formed as an integral part of the reamer 20. Alternatively, the second end 28 of the reamer 20 may be directly connected to the utility service 30. In operation, during the back-reaming or pull-back portion of directionally drilled installation, the boring machine 11 will rotate and retract pipe sections 18 from the drill string 14 which in turn pulls the reamer 20 and the utility service 30 through the borehole 16. The reamer 20 enlarges the borehole 16 to make room for the utility service 30 by cutting earthen material in front of the reamer 20 as the reamer is pulled through the borehole. The reamer 20 may rotate as it is pulled through the borehole 16 to cut away material at the face of the borehole. In rock formations, the reamer 20 spalls rock material from the face of the borehole 16 by producing small compressive fractures in the rock as the reamer cutters pass over the face of the borehole. For a vertical hole operation, or a push-reamed horizontal hole application, a threaded-connection may be implemented on the second end 28 of the reamer 20 for connection to the drill string 14.

Figure 2:
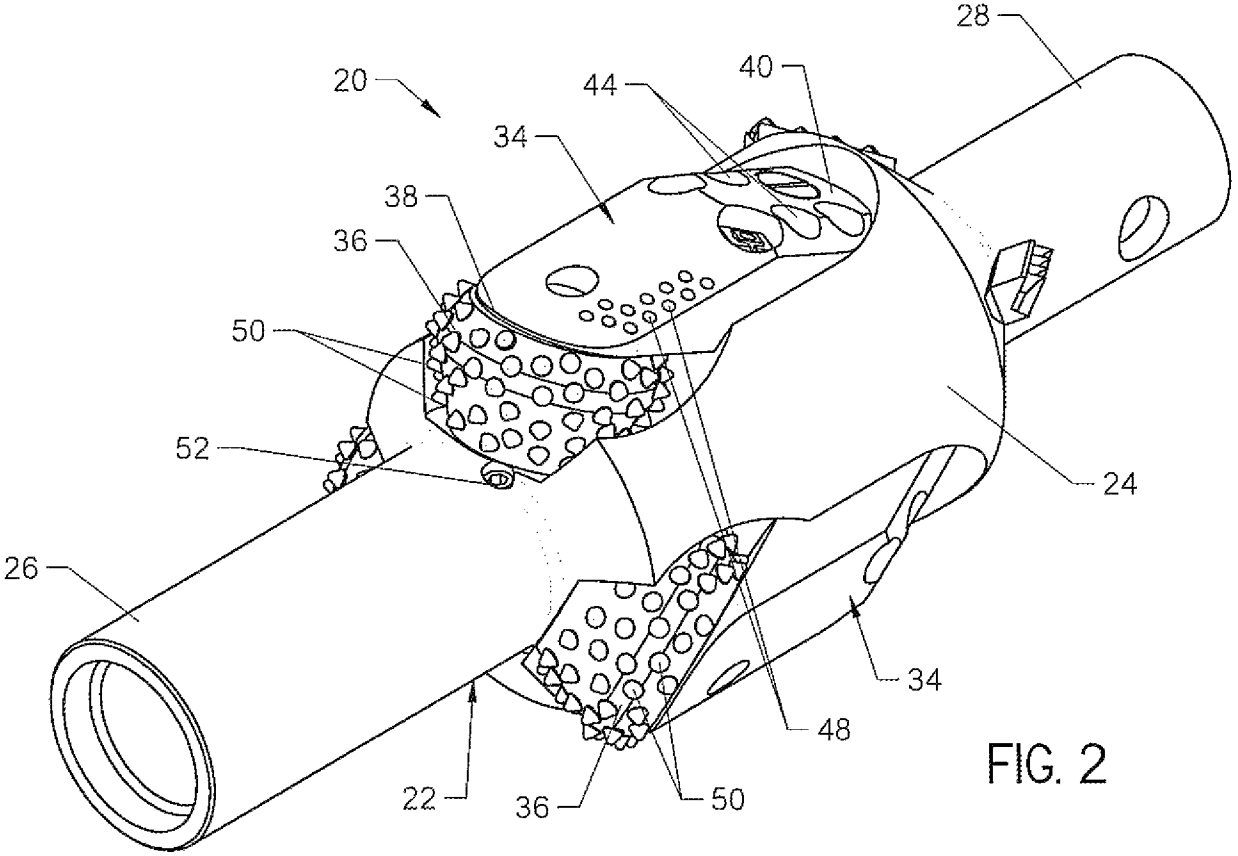
FIG. 2 is a perspective view of a reamer used in FIG. 1.
Figure 3:
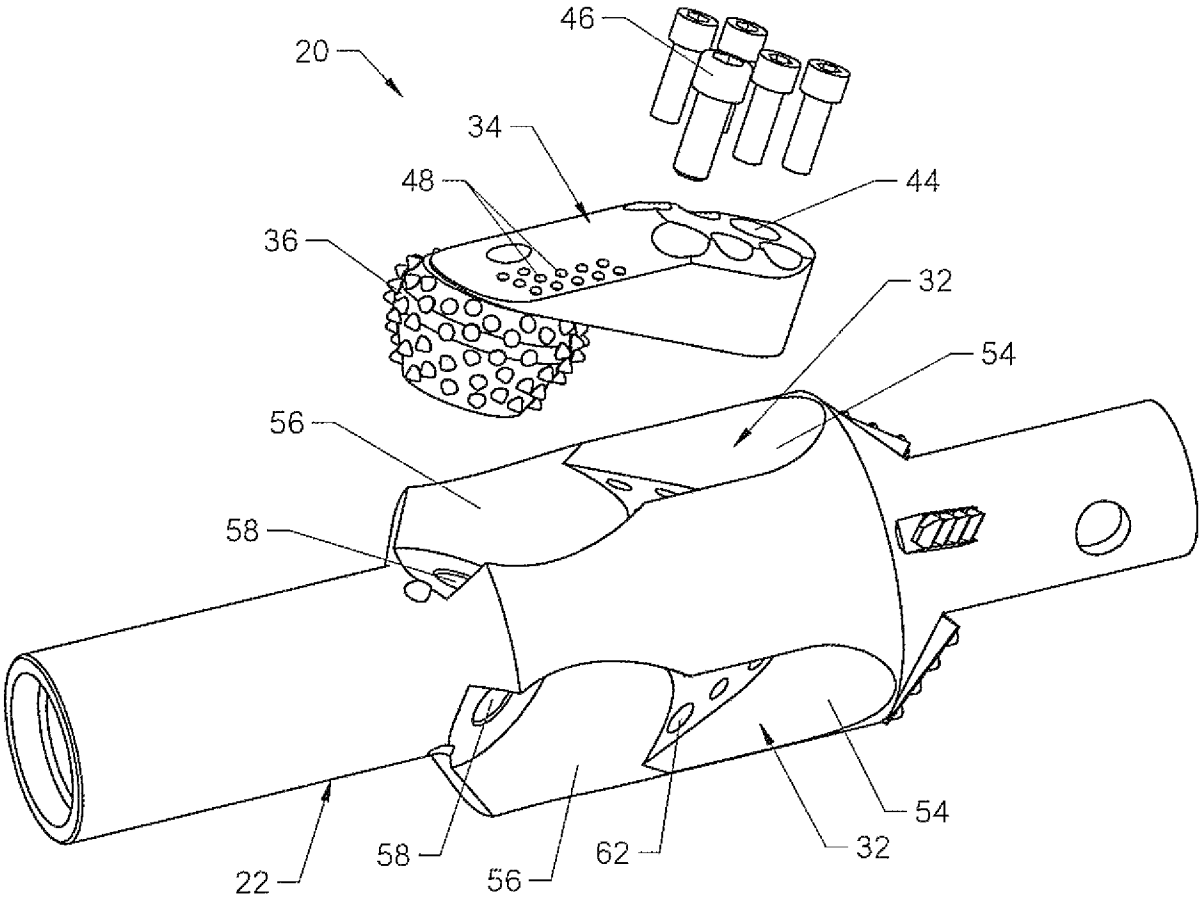
FIG. 3 is a partially exploded view of the reamer of FIG. 2.
Figure 4:
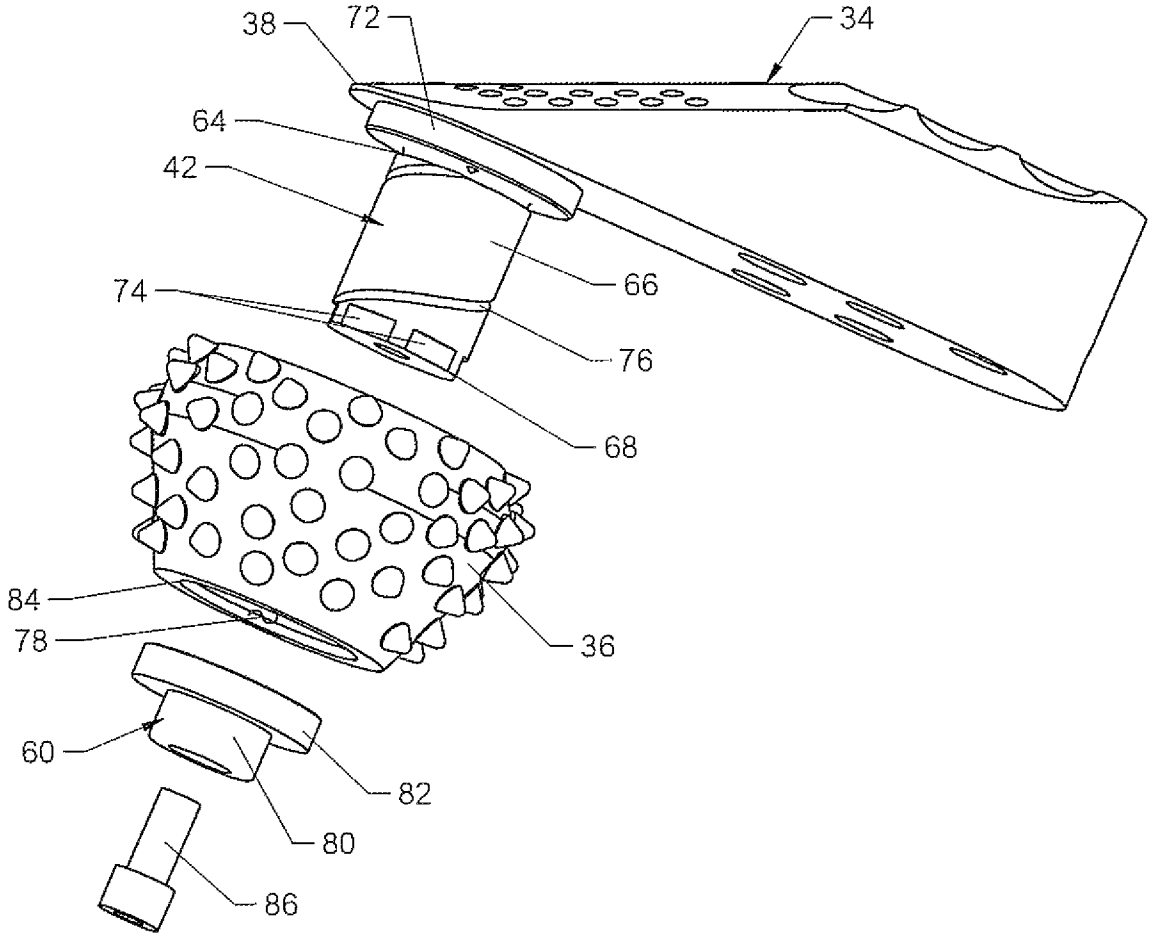
FIG. 4 is an exploded view of an arm and a rolling cutter for use with the reamer.

Turning to FIG. 2, the reamer 20 is shown in more detail. An intermediate section 24, the first end 26 and the second end 28 of the body 22 are shown. It shall be appreciated that the body 22 of the reamer 20 may take on other sizes and shapes as desired. The intermediate section 24 comprises a plurality of pockets 32 (FIG. 3). Secured within each of the pockets 32 are an arm 34 and a rolling cutter 36. The rolling cutter 36 may comprise a conical shape, cylindrical shape, tapered shape, or any shape capable of use with the reamer 20. Each arm 34 comprises a first end 38 and a second end 40. The first end 38 of the arm 34 is operably secured to the rolling cutter 36. The rolling cutter 36 is secured to the arm 34 via a spindle 42 (FIG. 4). The spindle 42 provides a rotational bearing surface for the rolling cutter 36 to rotate. The second end 40 of the arm 34 comprises a plurality of passages 44. A plurality of fasteners 46 (FIG. 3) may be disposed within the plurality of passages 44 and engage with the pocket 32 to secure the arm to the pocket. It may be appreciated that only one fastener 46 may be used to secure the arm 34 to the pocket 32 if desired. The arm 34 also comprises a plurality of wear protection inserts 48. The wear protection inserts 48 are situated on the leading side of rotation in order to protect the arms 34 against wear and tear during operation.

The rolling cutters 36, shown in FIG. 2, may be replaced with like rolling cutters or rolling cutters of a different size and shape. This allows an operator to use the same body 22 of the reamer 20 and just replace the rolling cutters 36 if the rolling cutters become worn during operation. The rolling cutters 36 may be replaced with rolling cutters of differing heights, allowing the same body 22 of the reamer 20 to be used to enlarge the borehole 16 (FIG. 1) to different diameters.

Continuing with FIG. 2, the rolling cutter 36 comprises a plurality of cutter elements 50 or hardened steel teeth affixed to the outer circumference of the rolling cutter. The cutter elements 50 may be made out of tungsten carbide or other hard and abrasion-resistant material. The cutter elements 50 may be affixed to the outer circumference of the rolling cutter 36 in a semi-random, non-symmetrical pattern. This type of spacing assures that the cutter elements 50 will not repeatedly fall into the same holes in the rock formation as the rolling cutters 36 are rotated. The cutter elements 50 may also be machined into the surface of the rolling cutter 36, rather than being affixed to the outer circumference of the rolling cutter. An advantage to using rolling cutters 36 with semi-random spaced cutter elements 50 is that each of the rolling cutters used on the reamer 20 may be identical. This allows the rolling cutters 36 to be individually replaced if needed. Alternatively, the cutter elements 50 may be spaced in a uniform manner if desired.

Figure 9:
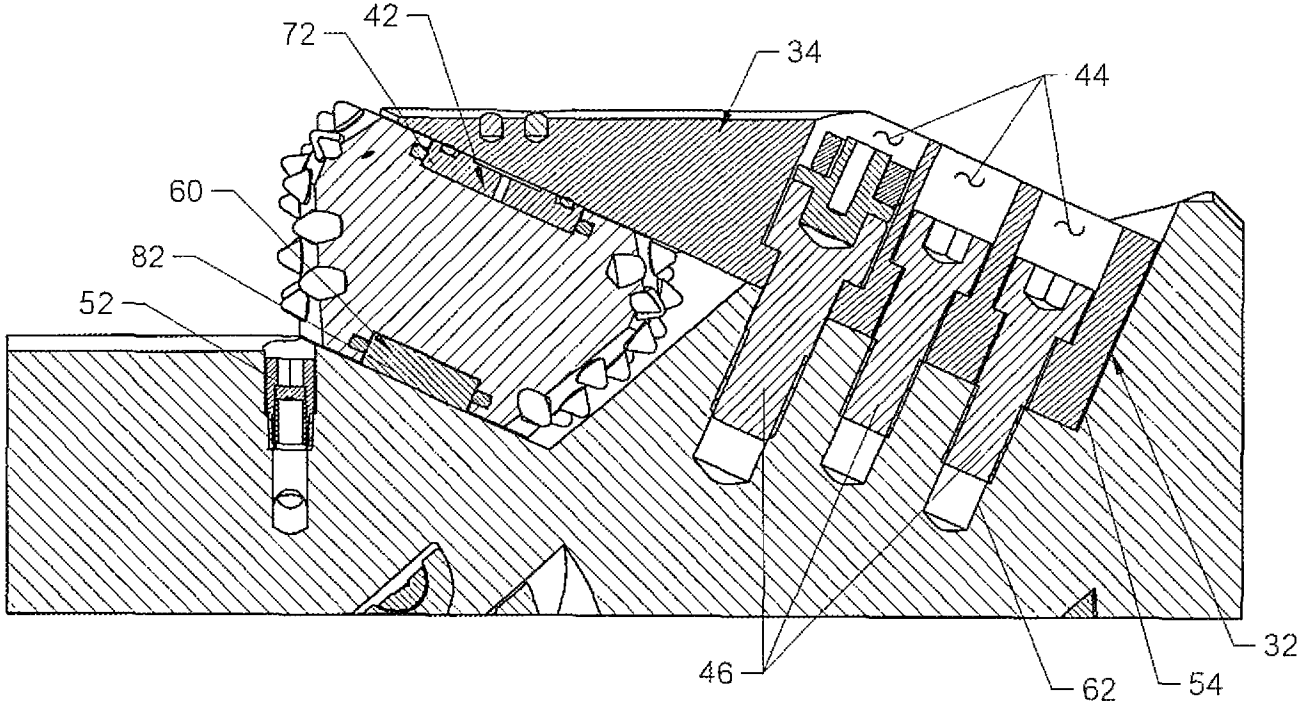
FIG. 9 is a section view along line II-II from FIG. 8.

A fluid nozzle 52 is also shown in FIG. 2. A plurality of the fluid nozzles 52 may be spaced apart about the body 22. The fluid nozzles 52 may be oriented such that the fluid exiting the nozzle travels in a radially outwards direction in the borehole 16 (FIG. 1). The fluid nozzles 52 may be placed such that the fluid travels largely parallel and in close proximity to the surface of the rolling cutters 36, as shown in FIG. 9. The fluid nozzles 52 may be offset to one side from the center line of the rotational axis of the reamer 20. This allows the fluid to sweep across the surface of the rolling cutter 36 just ahead of the rolling cutter's contact with the borehole 16. Alternatively, depending on which side of the center line the fluid nozzle 52 is placed, the fluid nozzle 52 helps to remove debris from the rolling cutters 36 moments after the cutter elements 50 lift from cutting the borehole 16. The fluid ejected from the fluid nozzles 52 helps to clear debris or foreign material from the surface of the rolling cutter 36 and assists in cooling the rolling cutters during operation.

Turning now to FIG. 3, the pockets 32 are shown in more detail. The pockets 32 comprise an arm section 54, a cutter section 56, and a retainer section 58. The pockets 32 may be formed along a length of the body 22. The body 22 of the reamer 20 may comprise any desired number of pockets 32. The body 22 shown in FIG. 3 comprises three pockets 32. The reamer 20 preferably has the same number of arms 34 and rolling cutters 36 as number of pockets 32. Each of the arms 34 and each of the rolling cutters 36 attached to the reamer 20 will each preferably comprise the same features described herein. However, it may be appreciated that certain features may be changed between each of the arms 34 and the rolling cutters 36 if desired. The arm 34 fits within the arm section 54 of the pocket 32, the rolling cutter 36 fits within the cutter section 56 of the pocket 32, and a retainer 60 (FIG. 4) fits within the retainer section 58 of the pocket. The arm section 54 of the pocket 32 comprises a plurality of openings 62 that correspond with the plurality of passages 44 formed in the arm 34. The plurality of fasteners 46 may pass through the plurality of passages 44 in the arm 34 and secure within the plurality of the openings 62 formed in the arm section 54 of the pocket 32. The plurality of fasteners 46 may thread into the plurality of openings 62 or may be tightly engaged with the plurality of openings.

Continuing with FIG. 3, the plurality of fasteners 46 may comprise screws or other fasteners known in the art to secure mechanical parts together. The screws may comprise socket head cap screws made of high strength grades. The plurality of fasteners 46 may each be of different shapes and sizes if desired. During operation, the fastener 46 closest to the first end 26 of the reamer 20 and on the leading side of the arm 34 as the reamer 20 is rotated tends to carry a larger portion of the loading than the other fasteners; thus, this fastener is preferably larger than the other fasteners 46. In a vertical borehole drilling operation, or in a push-reaming application, the reamer 20 rotates in the opposite direction as a pull-reaming application. Due to this, the design may be altered to place the larger fastener 46 and the wear protection inserts 48 on the opposite side of the arms as that shown, in FIG. 3. This allows the larger fastener 46 and the wear protection inserts 48 to be situated on the leading side of the rotation to better assist reamers intended for push-reaming applications.

Turning to FIG. 4, the arm 34 and the rolling cutter 36 are shown in greater detail. The spindle 42 is shown connected to the first end 38 of the arm 34. The spindle 42 comprises a first end 64, a body 66, and a second end 68. The first end 64 of the spindle 42 is connected to the arm 34 and comprises a projection 70 (FIG. 5) and a top flange 72. The second end of the spindle 68 comprises a plurality of flat surfaces 74. The spindle 42 also comprises one or more grease passageways 76. The rolling cutter 36 comprises a central passage 78. The spindle 42 passes through the central passage 78 of the rolling cutter 36 and engages with the retainer 60. The rolling cutter 36 rotates about the body 66 of the spindle 42 during operation. The body 66 and the top flange 72 of the spindle 42 serve as bearing surfaces for the rolling cutter 36 to rotate about. The grease passageway 76 provides a pathway for grease to lubricate the body 66 of the spindle 42 during operation.

Continuing with FIG. 4, the rolling cutter 36 is held in place on the spindle 42 by the retainer 60. The retainer 60 comprises a protrusion 80 and a top flange 82. The top flange 82 of the retainer 60 fits into the central passage 78 on a bottom end 84 of the rolling cutter 36. The retainer 60 is held onto the bottom end 84 of the rolling cutter 36 by a fastener 86. The fastener 86 may comprise a screw. The top flange 82 of the retainer 60 serves as a bearing surface for forces encountered during operation that drive the rolling cutter 36 downward towards the body 22 of the reamer 20 (FIG. 2).

As shown in FIG. 4, the rolling cutter 36 rotates without the use of any roller bearings. All surfaces contact in simple sliding motion. The cylindrical surface of the body 66 of the spindle 42 acts as a journal bearing with the central passage 78 of the rolling cutter 36. The top flange 72 of the spindle 42 acts as a simple sliding bearing for reaction of forces on the rolling cutter or rolling cutters 36 that would tend to force the rolling cutters outward. The spindle 42 may be made of a hardened copper-based bearing alloy. This material has a particularly high sliding load limit and sufficient strength. The spindle 42 and the retainer 60 may be both machined from solid bars of the copper bearing alloy or other suitable bearing alloy such as copper-beryllium alloys or Nitronic 60 stainless steel. Alternatively, the spindle 42 could be made from a steel or other alloy and have a sleeve made from the copper-based bearing alloy or other bearing alloy inserted around it. In addition, a thin ring of the copper bearing alloy or other bearing material could be used for the contact surfaces which bear the inward or outward axial loads of the rolling cutters 36 during operation.

Figure 5:
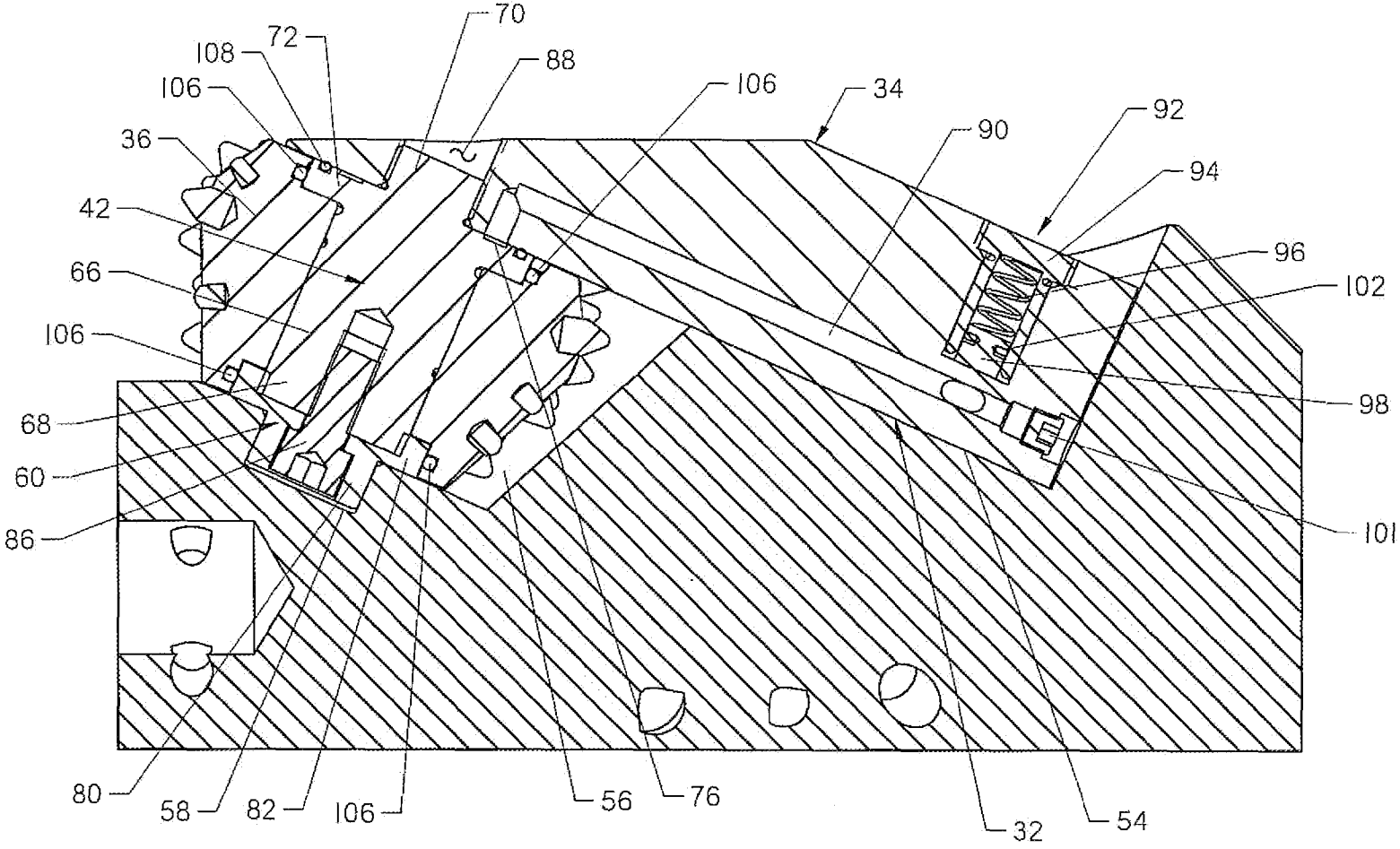
FIG. 5 is a section view along line I-I from FIG. 8.
Figure 8:
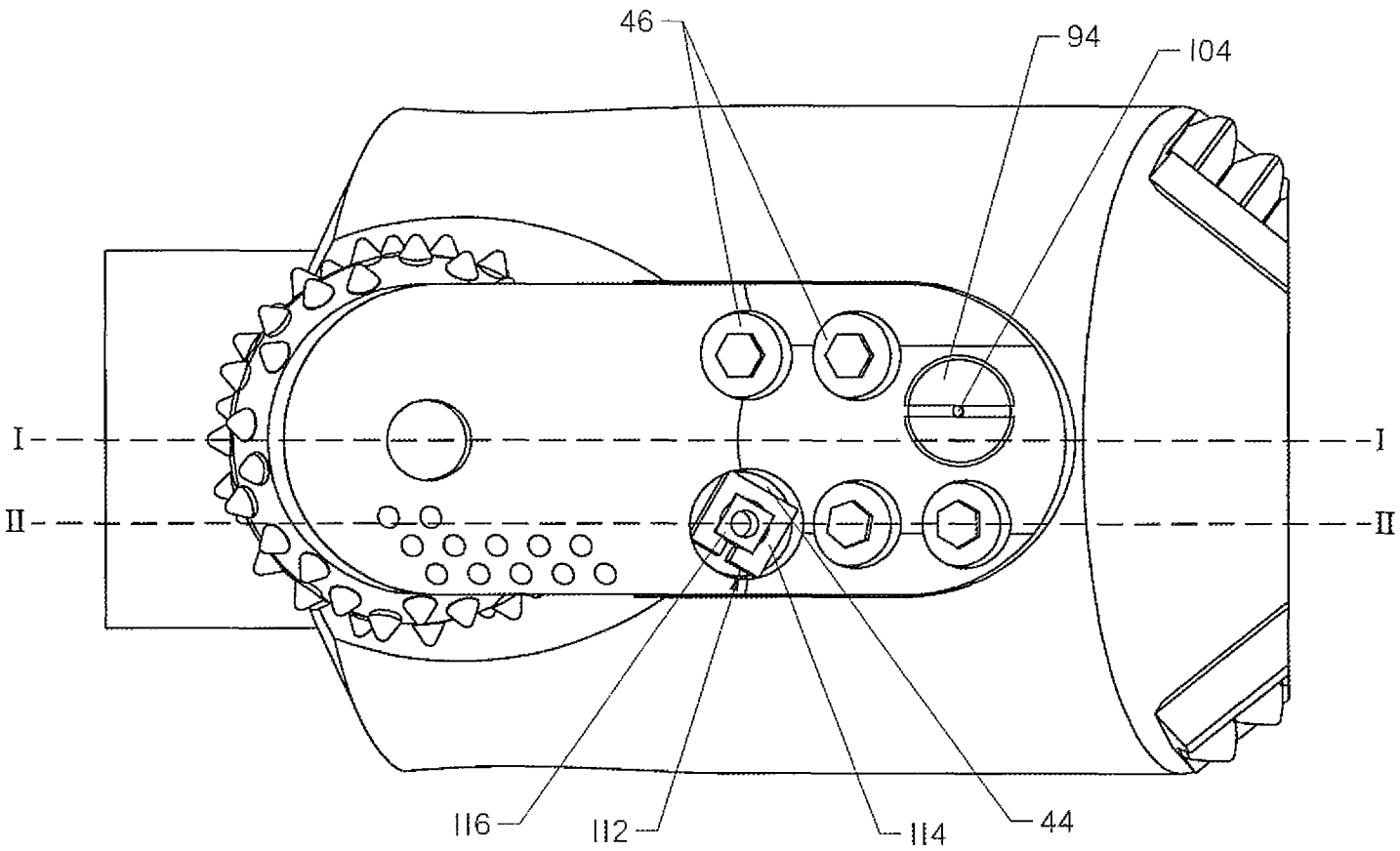
FIG. 8 is a top view of the reamer.

Turning now to FIG. 5, a section view along line I-I from FIG. 8 is shown. The arm 34 is shown within the arm section 54 of the pocket 32, the rolling cutter 36 is shown within the cutter section 56 of the pocket and the retainer 60 is shown within the retainer section 58 of the pocket 32. Unlike the retainer 60 and the arm 34, the rolling cutter 36 does not fit tightly within the cutter section 56 of the pocket 32 in order to allow room for the rolling cutter to rotate during operation.

Continuing with FIG. 5, the spindle 42 connects to the arm 34 via the projection 70. The projection 70 threads into an opening 88 formed on the arm 34. The spindle 42 may also be attached to the arm 34 by welding, brazing, pins, or interference fit. The attachment of the spindle 42 to the arm 34 may be a removable connection so that a worn or damaged spindle may be replaced independently of the cutter 36 or the arm 34. The plurality of flat surfaces 74 (FIG. 4) formed on the second end 68 of the spindle 42 allow the spindle to be tightly secured into the opening 88 on the arm 34 by providing surface area for a wrench to grab and tighten the connection between the spindle and the arm. The reamer 20 (FIG. 2) may rotate in a clockwise manner when operated, as viewed from looking down the first end 26 of the reamer 20. In contrast, the rolling cutters 36 may rotate counter-clockwise relative to the spindles 42, as viewed from the second end 68 of the spindle 42. The spindles 42 may attach to the arms 34 using a left-handed thread. This causes the spindles 42 to tighten as the reamer 20 is operated. The reamer 20 and the rolling cutters 36 may also be configured to rotate in directions opposite those just described if desired.

FIG. 5 also shows the second end 68 of the spindle 42 engaging with the top flange 82 of the retainer 60. The second end 68 of the spindle 42 is also shown secured to the retainer via the fastener 86. The protrusion 80 on the retainer 60 may tightly engage with the retainer section 58 of the pocket 32 or it may thread into the retainer section of the pocket. Alternatively, the protrusion 80 may have a geometric shape that corresponds with a geometric shape of the retainer section 58 of the pocket 32. The insertion of the retainer 60 into the retainer section 58 of the pocket 32 provides a two-point support for the rolling cutter 36 from loading introduced on the reamer 20 by the drill string 14 (FIG. 1). The load on the rolling cutter 36 and spindle 42 are shared by both the arm 34 and the retainer 60. This provides a more rigid and more secure mounting for each of the rolling cutters 36 than a cantilevered design.

A grease passage 90 formed in the arm 34 is also shown in FIG. 5. A pressure compensation system 92 is shown just above the grease passage 90. The grease passage 90 connects the area just under the pressure compensation system 92 to the spindle 42 and supplies grease to the spindle 42. The grease passageway 76 starts on the top flange 72 of the spindle 42 and spirals around the spindle 42. Grease from the grease passage 90 will pass into the grease passageway 76. The grease passageway 76 carries grease down the length of the body 66 of the spindle 42 to help lubricate the spindle 42 bearing surface. The grease passageway 76 may spiral around the body 66 of the spindle 42 or may be formed as a straight groove along the body of the spindle. Alternatively, a groove of any size or shape could be machined on the spindle 42 to carry the grease.

The pressure compensation system 92, shown in FIG. 5, comprises a plug 94, a spring 96, and a piston 98. A port 100 (FIG. 6) is located on the arm 34 for receiving the pressure compensation system 92. The plug 94 may be held within the arm using threads, a snap ring, pins, or other retention means known in the art. The piston 98 is a sliding piston and fits within the internal bore of the plug 94. The piston 98 contains a seal 102 for maintaining separation between the drilling fluid on the exterior of the reamer 20 (FIG. 2) and the grease inside the grease passage 90. The seal 102 may be an o-ring or other seals known in the art. The spring 96 maintains the pressure inside the pressure compensation system 92 just slightly above the exterior fluid pressure surrounding the reamer 20. A hole 104 (FIG. 8) on the top of the plug 94 provides an open passageway between the fluid on the exterior surface of the reamer 20 and the back side of the piston 98. In operation, as fluid pressure builds on the back side of the piston 98, it causes the pressure inside the pressure compensation system 92 to rise to a level just above the exterior fluid pressure. In this manner, the pressure inside the pressure compensation system 92 is always maintained just above the exterior fluid pressure. This minimizes any tendency of the exterior fluid from entering the grease passage 90 and the bearing area between the body 66 of the spindle 42 and the central passage 78 of the rolling cutter 36.

Continuing with FIG. 5, the top flange 82 of the retainer 60 and the top flange 72 of the spindle 42 serve as sealing surfaces. A plurality of seals 106 may be placed around the top flange 82 of the retainer 60 and the top flange 72 of the spindle 42 in order to prevent drilling fluid from contaminating the grease passageway 76. Preferably, the seals 106 may comprise o-ring seals composed of highly saturated nitrile material. Other O-ring materials such as urethane may alternatively be used. Alternatively, rotary lip seals of various materials known in the art can be used. A static seal 108 may also be implemented on the top flange 72 of the spindle 42 where it contacts the arm 34 to preclude drilling fluid from contaminating the grease passageway 76 and grease passage 90.

Figure 6:
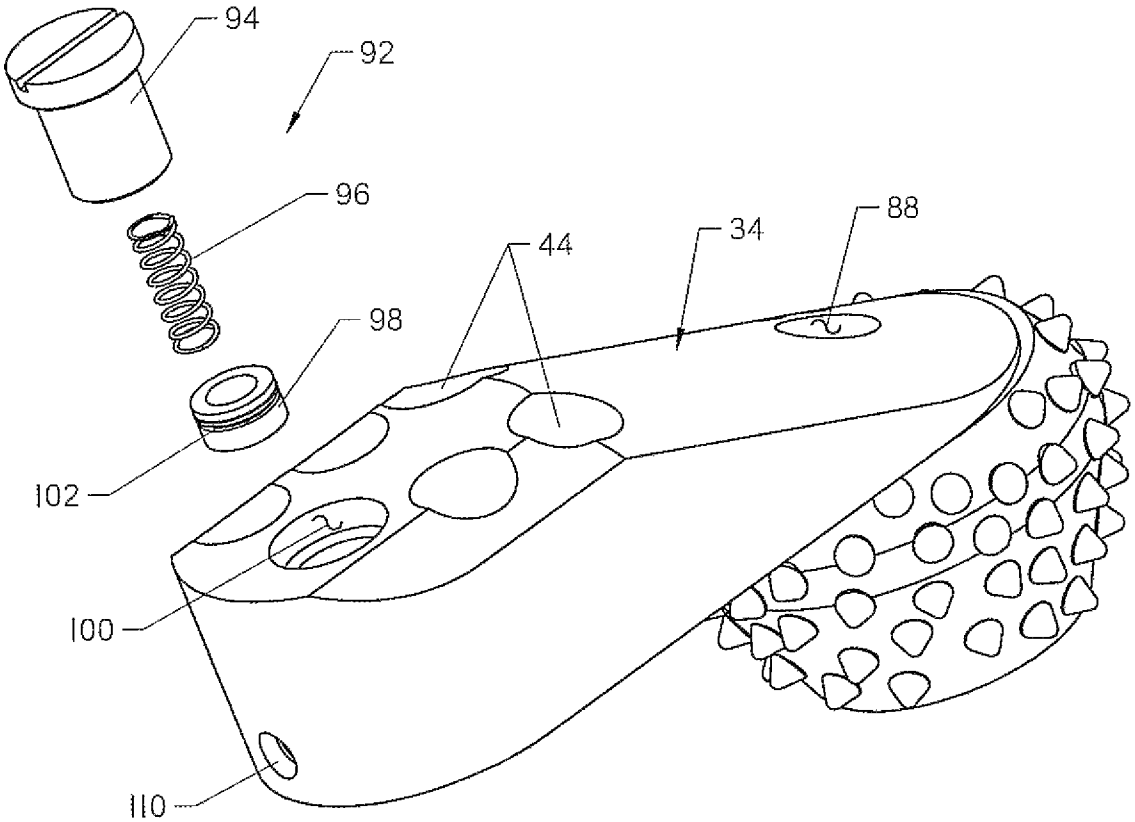
FIG. 6 is an exploded view of a pressure compensation system for use with the reamer.

Turning now to FIG. 6, the pressure compensation system 92 is shown in more detail. The plug 94, the spring 96, and the piston 98 are shown. The seal 102 is shown around the piston 98. The pressure compensation system 92 fits into the port 100 formed on the arm 34. The remaining passages 44 formed in the arm 34 are for the plurality of fasteners 46 (FIG. 3). A grease inlet passage 110 is also shown in FIG. 6. The grease passage inlet 110 provides grease to the grease passage 90 and the grease passageway 76 (FIG. 5) and is sealed with a plug 101 (FIG. 5) once grease has been supplied to the cutter 36, the arm 34, and the spindle 42 (FIG. 4). The opening 88 on the arm 34 for connection to the spindle 42 (FIG. 5) is also shown in FIG. 6.

Figure 7:
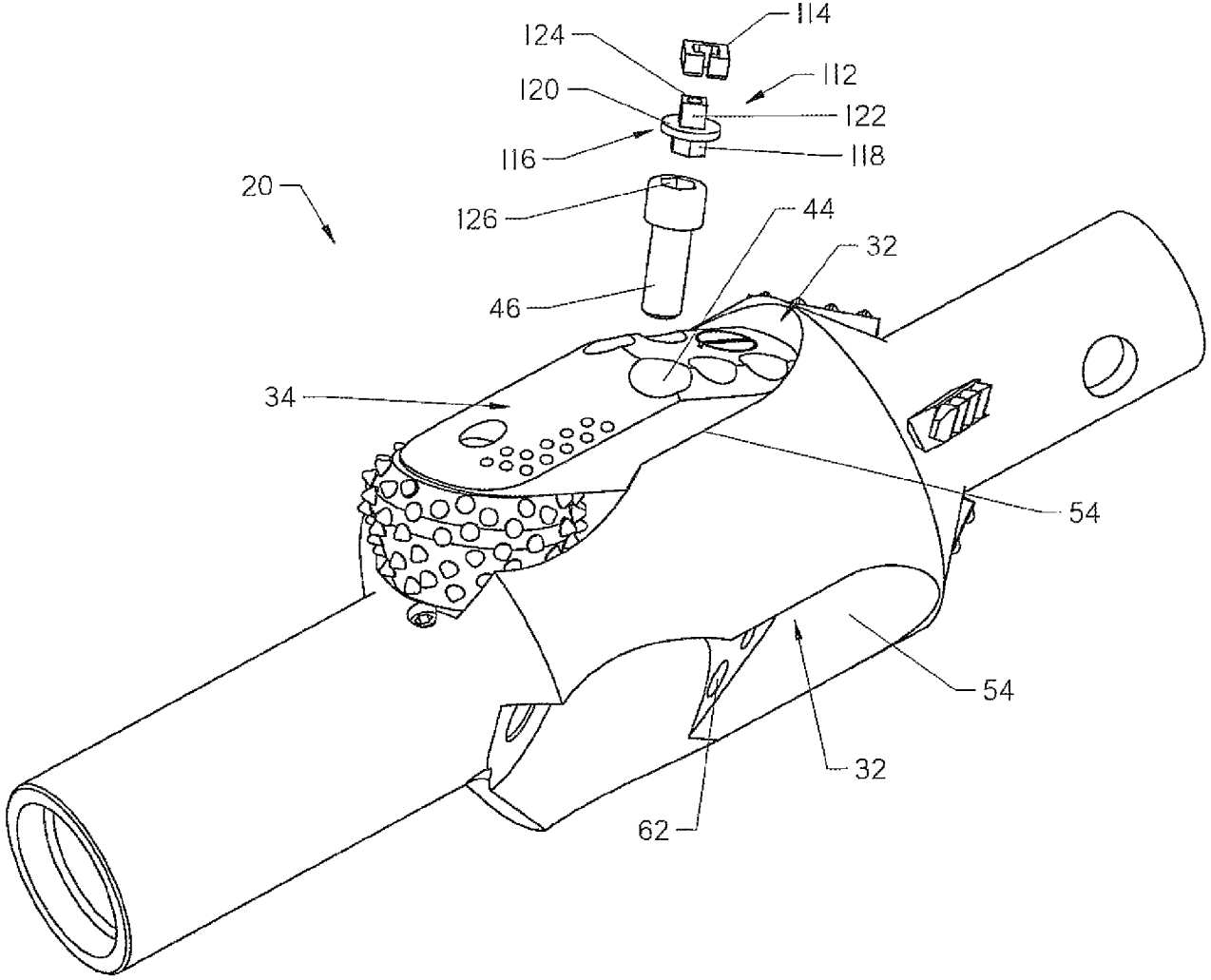
FIG. 7 is an exploded view of a mechanical lock for use with the reamer.

Turning now to FIG. 7, a mechanical lock 112 for use with the reamer 20 is shown. The mechanical lock 112 retains within one of the passages 44 at least one of the fasteners 46 securing the arm 34 to the pocket 32. The mechanical lock 112 will preferably be used on the largest fastener or the fastener 46 carrying the largest load. Alternatively, the mechanical lock 112 may be used on any or all of the fasteners 46 used to secure the arm 34 to the pocket 32. The mechanical lock 112 comprises a keeper 114 and a post 116, as shown in FIG. 7. The post 116 and the keeper 114 may be made of steel or other suitable metal of sufficient hardness and strength.

Continuing with FIG. 7, the post 116 may comprise a geometric lower protrusion 118, a flange 120, a geometric upper protrusion 122, and a threaded feature 124. The threaded feature 124 is formed in the geometric upper protrusion 122 and is used to facilitate removal of the post 116 if needed. The geometric lower protrusion 118 may comprise any geometric feature that corresponds with a geometric feature 126 of the fastener 46 being used with the mechanical lock 112, such as a hexagonal shape, a star-shape, or a multi-pointed recess. The geometric upper protrusion 122 may have a square cross-section or may comprise any number of sides. Alternatively, the geometric upper protrusion 122 may be star shaped. The keeper 114 may have an internal geometric feature corresponding to the geometric feature of the geometric upper protrusion 122. Externally, the keeper 114 may have corners capable of engaging with the wall of the passage 44 formed in the arm 34. The radial interference between the corners of the keeper 114 and the passage 44 may be selected based on the tightness of fit desired, but preferably will be 0.010" (0.25 mm) or less. The exterior surface of the keeper 114 shown in FIG. 7 has four corners, but it may be appreciated that any shape with a plurality of corners may be used for the exterior shape of the keeper 114.

Continuing with FIG. 7, in operation the fastener 46 to be used with the mechanical lock 112 may be inserted into its appropriate passage 44 in the arm 34 and threaded or secured into the corresponding opening 62 on the arm section 54 of the pocket 32. The fastener 46 may be torqued or tightened as desired. The geometric lower protrusion 118 of the mechanical lock 112 may be inserted into the geometric feature 126 of the fastener 46. The flange 120 of the post 116 may rest on top of the fastener once the post 116 is fully inserted within the fastener 46. The geometric upper protrusion 122 will be pointed up within the passage 44. The keeper 114 may then be placed over the geometric upper protrusion 122 and driven into the passage 44 with a hammer. The internal geometric feature of the keeper 114 will align with the corresponding geometric upper protrusion 122 on the post 116. Once in place, the corners of the exterior surface of the keeper 114 may dig into the passage 44 on the arm 34 and prevent the keeper 114 and post 116 from falling out, and may provide restriction of rotation of the fastener 46 should the fastener try to vibrate loose during operation of the reamer 20.

Turning to FIG. 8, the mechanical lock 112 is shown within the passage 44. The keeper 114 is shown around the geometric upper protrusion 122 of the post 116 and the corners of the keeper are shown digging into the sides of the passage 44. The keeper 114, as shown in FIG. 8, may have a slight opening on one side. This opening gives the keeper 114 a slight amount of deformation capability, or spring action, for easier insertion and removal from the passage 44. To remove the keeper 114 and the post 116, a screw can be threaded into the threaded feature 124 of the post and a hammer can be used to extract the keeper and the post from the passage 44. Once the keeper 114 and the post 116 have been removed, the fastener 46 can be removed using normal wrenching techniques. FIG. 8 also shows the plurality of fasteners 46 within the plurality of passages 44 and shows the hole 104 formed on the plug 94.

Turning now to FIG. 9, a section view of line II-II from FIG. 8 is shown. The plurality of fasteners 46 are shown disposed through the plurality of passages 44 formed in the arm 34 and are shown engaged with the plurality of openings 62 formed in the arm section 54 of the pocket 32. The top flange 72 of the spindle 42 and the top flange 82 of the retainer 60 are also shown. The plurality of fasteners 46 are preferably configured so that they are parallel with the spindle 42 when the reamer 20 (FIG. 2) is assembled. If only one fastener 46 is used to secure the arm 34 to the pocket 32, that fastener may be configured so that it is parallel to the spindle 42 when the reamer 20 is assembled. The fasteners 46 may also be configured such that they are not parallel or they are perpendicular to the spindle 42 when the reamer 20 is assembled. The mechanical lock 112 is also shown engaged with one of the fasteners 46 in FIG. 9. FIG. 9 further shows the fluid nozzle 52.

Figure 10:
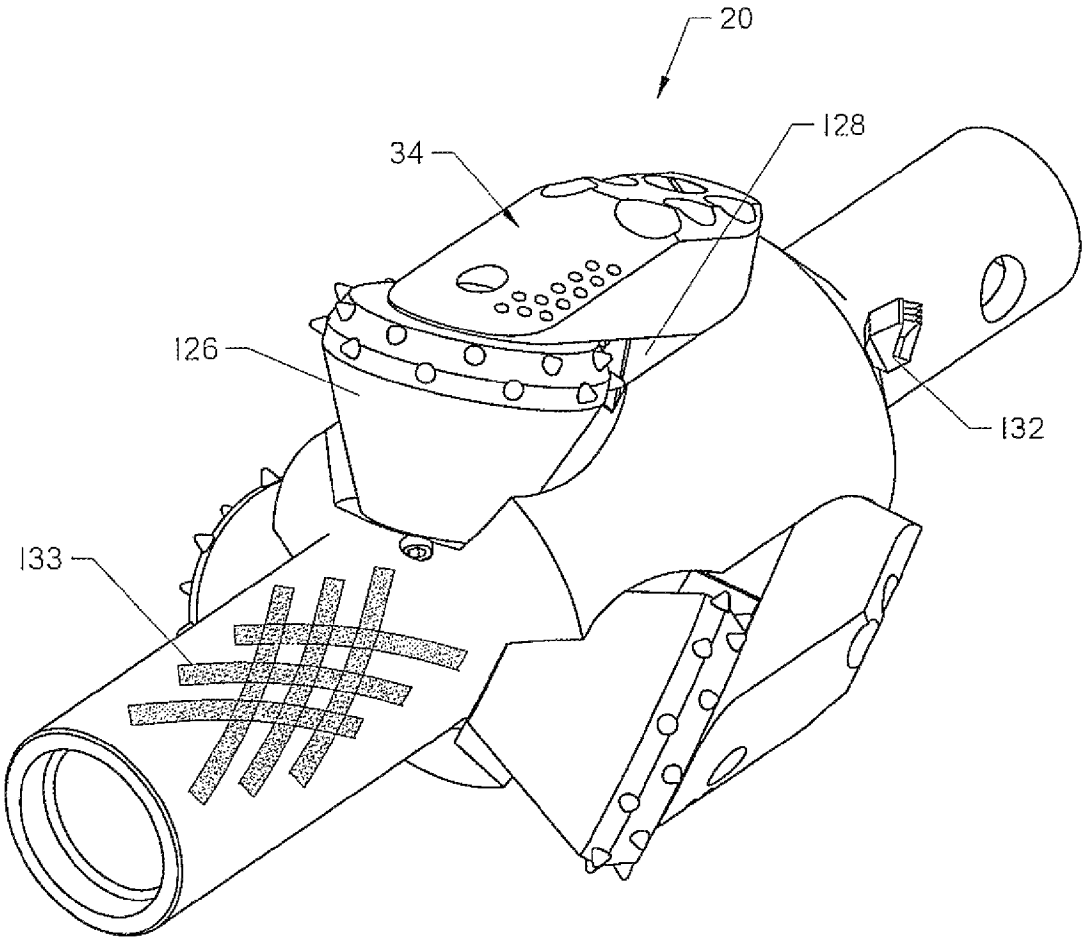
FIG. 10 is a perspective view of the reamer using a plurality of taller rolling cutters.
Figure 11:
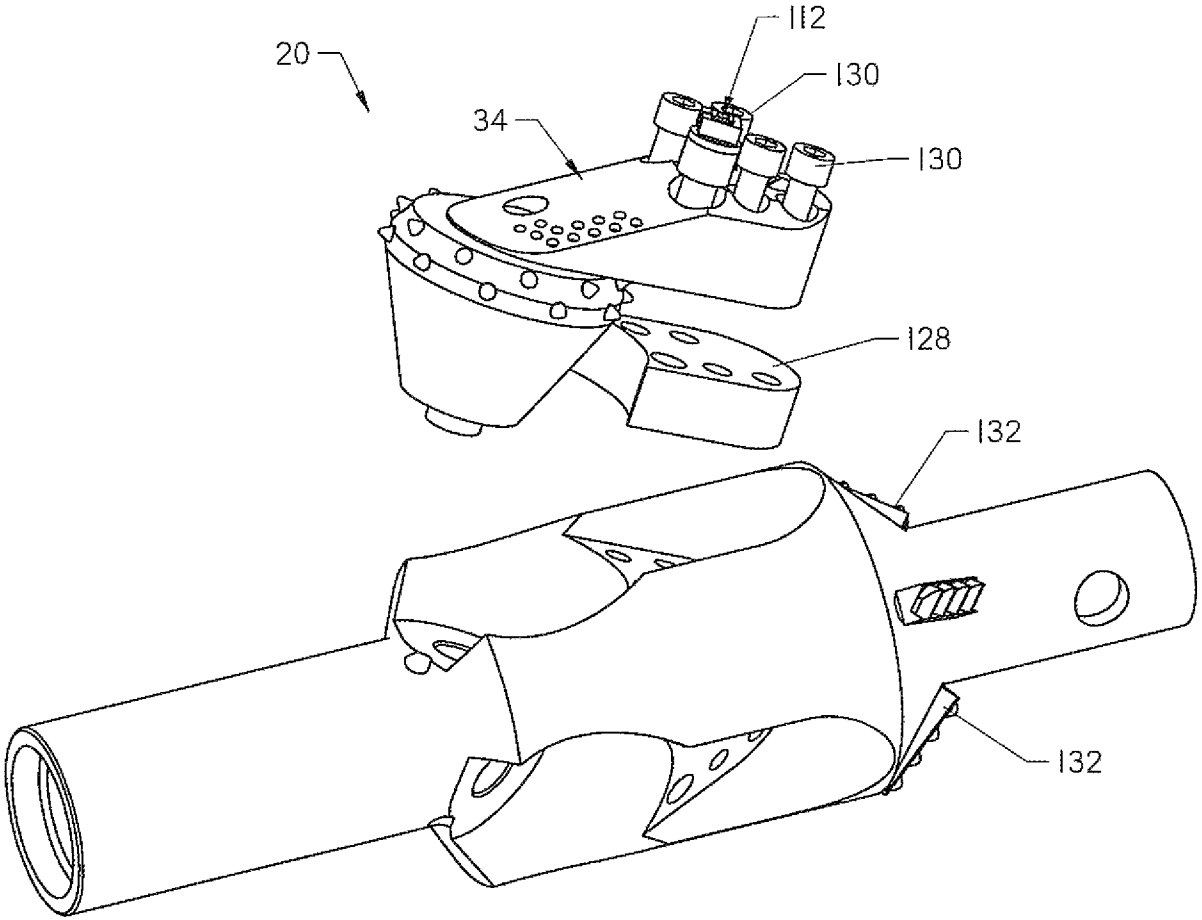
FIG. 11 is a partially exploded view of FIG. 10.

Turning now to FIGS. 10 and 11, the reamer 20 with a plurality of taller rolling cutters 126 is shown. For simplicity of illustration, not all of the cutter elements 50, like those shown in FIG. 2, are illustrated on the taller rolling cutters 126. It should be appreciated that in the preferred embodiment, the taller rolling cutters 126 may have a semi-random pattern of cutting elements 50 similar to the rolling cutters 36 shown in FIG. 2. The taller rolling cutters 126 may be used with the reamer 20 in order to enlarge the borehole 16 (FIG. 1) to a larger diameter. A spacer 128, as shown in FIG. 11, may be added under the arm 34 when the taller rolling cutters 126 are used with the reamer 20. The addition of the spacer 128 allows the clamping load of the fasteners 46 that hold the arm 34 in place to be maintained. The spacer 128 may be made from steel or other metal of suitable strength and rigidity. The use of the taller rolling cutters 126 and the spacer 128 also requires the use of taller fasteners 130, but the same sized mechanical lock 112 can be used to maintain the taller fasteners 130 in place. Alternatively, a different set of arms with an integral spacing section may be used instead of adding the spacer 128.

Continuing with FIGS. 10 and 11, abrasive wear protection may be added to the first end 26 or the second end 28 of the reamer 20. The wear protection may include carbide teeth, carbide inserts, synthetic diamond inserts, wear bars, welded hard-facing material, or other wear-resistant assembly structures. FIGS. 10 and 11 show, for example, wear bars 132 attached to the second end 28 of the reamer 20, and welded hard-facing material 133 on the first end 26 of the reamer. The wear protection provides wear resistance in the event the reamer 20 will need to be pushed or pulled opposite the reaming direction within the borehole 16 (FIG. 1). If cuttings or debris are not properly flushed from the borehole 16 as the reaming process is conducted, rock cuttings can build up in the borehole 16 behind the reamer 20. The wear protection helps if the reamer 20 has to be pushed back through the borehole 16 with rock cuttings partially blocking the borehole. In addition, cuttings trapped in front of the reamer 20 can also lead to wear on the reamer 20. The use of the wear protection reduces wear on the first end 26 of the reamer 20 in front of the rolling cutters 36.

Various modifications can be made in the design and operation of the present invention without departing from its spirit. Thus, while the preferred construction and modes of operation of the invention have been explained in what is now considered to represent its best embodiments, it should be understood that within the scope of the appended claims, the invention may be practiced otherwise than as specifically illustrated and described.

What is claimed is:

1. A reamer for use in underground drilling operations, the reamer comprising:

a body;

a pocket formed on the body, wherein the pocket comprises a retainer section, a cutter section, and an arm section;

an arm configured to fit within the arm section of the pocket;

a grease passage and a pressure compensation system disposed within the arm;

a rolling cutter configured to fit within the cutter section of the pocket;

a retainer configured to fit within the retainer section of the pocket;

a fastener to secure the arm to the arm section of the pocket;

a spindle connected at a first end to the arm and at a second end to the retainer; wherein the rolling cutter fits over the spindle and is held between the arm and the retainer within the cutter section of the pocket; and wherein the rolling cutter rotates about the spindle without the use of roller bearings.

2. The reamer of claim 1 wherein the fastener is parallel to the spindle.

3. The reamer of claim 1 further comprising a plurality of non-symmetrical spaced cutter elements affixed to the rolling cutter.

4. The reamer of claim 1 wherein the arm, the rolling cutter, and the spindle are independently replaceable.

5. The reamer of claim 1 wherein the rolling cutter is replaceable.

6. The reamer of claim 1 wherein the rolling cutter is replaceable with a rolling cutter of a different size.

7. The reamer of claim 1 wherein the rolling cutter is replaceable with a taller rolling cutter.

8. The reamer of claim 7 further comprising a spacer placed underneath the arm to allow the taller rolling cutter to fit within the cutter section for rotation therein.

9. The reamer of claim 1 wherein the pocket is formed along a length of the body.

10. The reamer of claim 1 wherein the pressure compensation system comprises a plug, a spring, and a piston.

11. The reamer of claim 1 wherein a grease passageway is formed in the spindle.

12. The reamer of claim 1 wherein a drill pipe is connected to a first end of the body.

13. The reamer of claim 1 wherein a swivel is connected to a second end of the body.

14. The reamer of claim 1 wherein the fastener comprises a screw.

15. The reamer of claim 1 further comprising a mechanical lock for use with the fastener.

16. The reamer of claim 1 further comprising:

a plurality pockets formed on the body, wherein each of the plurality of pockets comprises a retainer section, a cutter section, and an arm section;

a plurality of arms each configured to fit within the arm section of each of the plurality of pockets;

a plurality of grease passages and a plurality of pressure compensation systems disposed within each of the plurality of arms;

a plurality of rolling cutters each configured to fit within the cutter section of each of the plurality of pockets;

a plurality of retainers each configured to fit within the retainer section of each of the plurality of pockets;

a plurality of fasteners each disposed within each of the plurality of arms to secure the plurality of arms to the arm section of each of the plurality of pockets;

a plurality of spindles each connected at a first end to each of the plurality of arms and at a second end to each of the plurality of retainers; wherein each of the plurality of rolling cutters fit over each of the plurality of spindles and are held between the plurality of aims and the plurality of retainers within the cutter section of each of the plurality of pockets; and wherein the plurality of rolling cutters rotate about the plurality of spindles without the use of roller bearings.

17. The reamer of claim 16 wherein the plurality of rolling cutters have the same pattern of non-symmetrically spaced cutter elements.

18. A reamer for use in underground drilling operations, the reamer comprising:

a body;

at least one pocket formed on the body, wherein the pocket comprises a retainer section, a cutter section, and an arm section;

an arm configured to fit within the arm section of the pocket;

a grease passage and a pressure compensation system disposed within the arm;

a rolling cutter configured to fit within the cutter section of the pocket;

a retainer configured to fit within the retainer section of the pocket;

a fastener disposed within the arm to secure the arm to the arm section of the pocket;

a spindle connected at a first end to the arm and at a second end to the retainer; wherein the rolling cutter fits over the spindle and is held between the arm and the retainer within the cutter section of the pocket;

wherein the fastener is parallel to the spindle;

wherein the rolling cutter rotates about the spindle without the use of roller bearings; and wherein the rolling cutter is replaceable with a rolling cutter of a different size.

19. The reamer of claim 18 wherein the rolling cutter is replaceable with a taller rolling cutter.

20. The reamer of claim 19 further comprising a spacer placed underneath the arm to allow the taller rolling cutter to fit within the cutter section for rotation therein.

21. The reamer of claim 18 wherein the pressure compensation system comprises a plug, a spring, and a piston.

22. The reamer of claim 18 wherein a grease passageway is formed in the spindle.

23. The reamer of claim 18 wherein a drill pipe is connected to a first end of the body.

24. The reamer of claim 18 wherein a swivel is connected to a second end of the body.

25. The reamer of claim 18 wherein the fastener comprises a screw.

26. The reamer of claim 18 further comprising a mechanical lock for use with the fastener.

27. The reamer of claim 18 further comprising a plurality of non-symmetrical spaced cutter elements affixed to the rolling cutter.

28. The reamer of claim 27 wherein the non-symmetrical spaced cutter elements comprise a hard and abrasion-resistant material.

* * * * *